US010935017B2

(12) United States Patent
Kim et al.

(10) Patent No.: US 10,935,017 B2
(45) Date of Patent: Mar. 2, 2021

(54) LINEAR COMPRESSOR

(71) Applicant: LG Electronics Inc., Seoul (KR)

(72) Inventors: Hyunsoo Kim, Seoul (KR); Geonwoo Kim, Seoul (KR); Chulgi Roh, Seoul (KR)

(73) Assignee: LG Electronics Inc., Seoul (KR)

( * ) Notice: Subject to any disclaimer, the term of this patent is extended or adjusted under 35 U.S.C. 154(b) by 93 days.

(21) Appl. No.: 16/270,088

(22) Filed: Feb. 7, 2019

(65) Prior Publication Data

US 2019/0309743 A1 Oct. 10, 2019

(30) Foreign Application Priority Data

Apr. 10, 2018 (KR) ..... 10-2018-0041731

(51) Int. Cl.
*F04B 39/12* (2006.01)
*F04B 35/04* (2006.01)
(Continued)

(52) U.S. Cl.
CPC ..... *F04B 39/121* (2013.01); *F04B 35/04* (2013.01); *F04B 35/045* (2013.01);
(Continued)

(58) Field of Classification Search
CPC .... F04B 35/045; F04B 39/0055; F04B 35/04; F04B 39/08; F04B 39/121
(Continued)

(56) References Cited

U.S. PATENT DOCUMENTS 6,824,365 B2 * 11/2004 Park ..... F04B 39/0061 181/403
8,057,200 B2 * 11/2011 Kang ..... F04B 39/0055 417/540
(Continued)

FOREIGN PATENT DOCUMENTS

CN 101014770 8/2007
CN 101443552 5/2009
(Continued)

OTHER PUBLICATIONS

Extended European Search Report in European Application No. 18197954.3, dated Feb. 15, 2019, 8 pages.
(Continued)

*Primary Examiner* — Patrick Hamo
(74) *Attorney, Agent, or Firm* — Fish & Richardson P.C.

(57) ABSTRACT

A linear compressor includes a shell, a frame in the shell, a cylinder defining a compression space, a piston in the cylinder, a motor assembly that drives the piston, a discharge cover unit defining a discharge space that receives refrigerant from the compression space, a discharge valve that selectively opens and closes the compression space, and a valve spring assembly that provides elastic force that causes the discharge valve to contact a front surface of the cylinder. The discharge cover unit includes a cover housing, the cover housing that couples the frame, a dividing sleeve that extends from an inside of the cover housing in a longitudinal direction of the shell and that divides the discharge space into discharge chambers, and a discharge cover that inserts into the inside of the cover housing and that contacts an end portion of the dividing sleeve.

20 Claims, 11 Drawing Sheets

(51) Int. Cl.
*F04B 39/08* (2006.01)
*F04B 39/00* (2006.01)
*F04B 39/14* (2006.01)

(52) U.S. Cl.
CPC ..... *F04B 39/0055* (2013.01); *F04B 39/08* (2013.01); *F04B 39/125* (2013.01); *F04B 39/14* (2013.01)

(58) Field of Classification Search
USPC ..... 417/417
See application file for complete search history.

(56) References Cited

U.S. PATENT DOCUMENTS

| | | | | |
|---|---|---|---|---|
| 8,496,453 | B2 * | 7/2013 | Kang | F04B 35/045 417/417 |
| 2007/0009370 | A1 * | 1/2007 | Kim | F04B 35/045 417/417 |
| 2009/0081054 | A1 * | 3/2009 | Kang | F04B 39/0055 417/312 |
| 2013/0058816 | A1 * | 3/2013 | Kim | F04B 39/125 417/437 |
| 2015/0004027 | A1 * | 1/2015 | Kang | F04B 35/045 417/417 |
| 2015/0219086 | A1 * | 8/2015 | Puff | F04B 39/0072 417/312 |
| 2015/0369224 | A1 * | 12/2015 | Kim | F04B 39/0292 417/443 |

FOREIGN PATENT DOCUMENTS

| | | |
|---|---|---|
| CN | 102979698 | 3/2013 |
| CN | 103629082 | 3/2014 |
| CN | 104797820 | 7/2015 |
| CN | 204692021 | 10/2015 |
| CN | 107339206 | 11/2017 |
| CN | 107339223 | 11/2017 |
| EP | 3130804 | 2/2017 |
| JP | H1122642 | 1/1999 |
| KR | 10-2017-0124904 | 11/2017 |
| WO | WO2014053040 | 4/2014 |

OTHER PUBLICATIONS

Chinese Office Action in Chinese Appln. No. 201811209518.0, dated Apr. 26, 2020, 15 pages (with English translation).

* cited by examiner

LINEAR COMPRESSOR

CROSS-REFERENCE TO RELATED APPLICATIONS

The present application claims priority under 35 U.S.C. 119 and 35 U.S.C. 365 to Korean Patent Application No. 10-2018-0041731, filed on Apr. 10, 2018, which is hereby incorporated by reference in its entirety.

FIELD

The present disclosure relates to a linear compressor.

BACKGROUND

A compressor is a mechanical device that can receive power from a power generating device such as an electric motor or a turbine to increase pressure by compressing air, refrigerant, or various other operating gases. Compressors are used in various household appliances and industry.

The compressors can be classified into reciprocating compressors, rotary compressors, and scroll compressors.

A linear compressor may improve its compression efficiency without mechanical loss that may occur when rotary motion of the motor is converted into linear motion. For example, a piston of a linear motor may be directed connected to the driving motor that causes the piston to reciprocate linearly and such linear compressor may have a simple structure among the reciprocating compressors.

The linear compressor may be configured to suction and compress refrigerant while the piston is linearly reciprocated within a cylinder by a linear motor in a closed shell and then discharge refrigerant.

In some cases, a linear compressor may include a discharge valve, a spring assembly for supporting the discharge valve, and a discharge cover on which a spring assembly is seated.

In some cases, a discharge cover assembly may be formed by assembling the discharge cover, the spring assembly, and the discharge valve, thereby forming a discharge space through which the refrigerant is discharged. The discharge cover is formed by stacking a plurality of covers made or steel.

For example, a discharge cover of a linear compressor may be composed of a total of six components.

The six components may include a first cover portion on which the spring assembly is seated and which forms a first space portion in which the refrigerant flowing in through the discharge valve is accommodated, a second cover portion which forms a second space portion in which the refrigerant passing through the first space portion is accommodated, a third cover portion which forms a third space portion in which the refrigerant having passed through the second space portion is received, and a guide pipe which guides the refrigerant in the second space portion to a side of the third space portion, a cover pipe through which the refrigerant having passed through the third space portion is discharged outside the cover, and a cover head which is provided at one side of the third cover portion.

In some cases, in order to manufacture the discharge cover, the six components described above are required, and at least the first cover portion, the second cover portion, and the third cover portion among the six components may be welded and fixed to each other.

In some cases, a clearance or gap may be produced in a process of welding the first cover portion and the second cover portion, and as a result, refrigerant may leak through the clearance formed between the first cover portion and the second cover portion.

In some cases, the discharge cover includes a large number of components, which may lead to increases of the product unit price and the working time. In some cases, various portions of the steel material are welded by skilled welders, where managing the dimensions between the respective portions may be challenging.

SUMMARY

One objective of the present disclosure is to provide a linear compressor in which leakage of refrigerant flowing in a discharge cover can be prevented.

Another objective of the present disclosure is to provide a Linear compressor which can shorten the working time and facilitate the dimension management of the discharge cover by omitting the welding process for each component constituting the discharge cover.

Another objective of the present disclosure is to provide a linear compressor in which the number of components for assembling the discharge cover is remarkably reduced, and assembly can be simplified.

Another objective the present disclosure is to provide a linear compressor in which the discharge cover of the steel material of the related art is manufactured by aluminum die casting and can attain a noise reduction effect equal to or higher than that of existing ones.

According to one aspect of the subject matter described in this application, linear compressor includes a shell, a frame located inside of the shell, the frame including a frame head and frame body that extends from a center of a rear surface of the frame head in a longitudinal direction of the shell, a cylinder located inside of the frame body and configured to insert to the frame body through the frame head, the cylinder defining a compression space in a front end portion of the cylinder, a piston located inside of the cylinder and configured to move relative to the cylinder, a motor assembly configured to drive the piston to move in an axial direction of the cylinder to compress refrigerant in the compression space, a discharge cover unit that is configured to couple to a front surface of the frame and that defines a discharge space configured to receive refrigerant discharged from the compression space, a discharge valve located at a front surface of the cylinder and configured to selectively open and close the compression space, and a valve spring assembly configured to insert into the discharge cover unit and configured to provide elastic force that causes the discharge valve to contact the front surface of the cylinder. The discharge cover unit includes a cover housing that defines the discharge space, the cover housing having a rear surface configured to couple to a front surface of the frame head, a dividing sleeve that extends from an inside of the cover housing in the longitudinal direction of the shell and that divides the discharge space into a plurality of discharge chambers, and a discharge cover configured to insert into the inside of the cover housing and configured to contact an end portion of the dividing sleeve.

Implementations according to this aspect may include one or more of the following features. For example, the cover housing may define an opening at a rear surface of the cover housing, where the rear surface of the cover housing defines the discharge space at the inside of the cover housing. The discharge cover is configured to cover the opening defined at the rear surface of the cover housing.

In some implementations, the cover housing includes a chamber portion having a front portion that is closed and a rear portion that is opened, the chamber portion extending in the longitudinal direction of the shell and defining the discharge space, and a flange portion that is bent from a rear end of the chamber portion and that is configured to contact the front surface of the frame head, where the dividing sleeve extends from a rear surface of the front portion of the chamber portion toward the rear portion of the chamber portion.

In some implementations, the dividing sleeve has a cylindrical shape, where an outer diameter of the dividing sleeve is less than an inner diameter of the chamber portion. In some examples, the plurality of discharge chambers include an inner chamber located at an inner side of the dividing sleeve and an outer chamber located at an outer side of the dividing sleeve, and the dividing sleeve defines a guide groove that is located at an inner circumferential surface of the dividing sleeve and that is configured to guide refrigerant from the inner chamber to the outer chamber.

In some implementations, the guide groove includes a first guide groove that extends from the inner circumferential surface of the dividing sleeve in a longitudinal direction of the dividing sleeve, and a second guide groove that extends in a circumferential direction of the dividing sleeve and that is connected to the first guide groove. In some examples, the linear compressor further includes a communication groove that is recessed from the end portion of the dividing sleeve and that extends to the second guide groove, where the discharge cover is configured to discharge refrigerant to the inner chamber. The first guide groove and the second guide groove may be configured to guide refrigerant from the inner chamber to the outer chamber through the communication groove.

In some implementations, the communication groove is spaced apart from the first guide groove in the circumferential direction of the dividing sleeve. In some examples, the linear compressor may further include a cover pipe that is configured to couple to the chamber portion and that is configured to discharge refrigerant from the discharge space to an outside of the cover housing. The chamber portion may define a recessed portion that is recessed from the front portion of the chamber portion and that allows the cover pipe to avoid interference with the chamber portion.

In some implementations, the cover housing further includes a support device fixing portion that extends forward from a front surface of the chamber portion in the longitudinal direction of the shell and that defines a fastening groove at an outer circumferential surface of the support device fixing portion, where the outer circumferential surface of the support device fixing portion is configured to connect to an inner circumferential surface of the shell based on insertion of a support device into the fastening groove.

In some implementations, the support device includes a pair of damping units, where each damping unit has a first end portion configured to connect to the outer circumferential surface of the support device fixing portion and a second end portion configured to connect to the inner circumferential surface of the shell. Each damping unit may include a support leg, a cushion pad configured to be positioned between an upper-end portion of the support leg and the support device fixing portion, an elastic member having a first end portion supported by a lower end portion of the support leg, and a shell sheet coupled to a second end portion of the elastic member.

In some implementations, the support leg includes a leg main body that extends toward the inner circumferential surface of the shell by a predetermined length, a head support portion that is located at an upper-end portion of the leg main body, that has a round shape, and that is configured to contact the outer circumferential surface of the support device fixing portion, and a fastening protrusion that protrudes from a center of the head support portion and that is configured to insert into the fastening groove of the support device fixing portion through the cushion pad. In some implementations, an outer diameter of the chamber portion is less than an outer diameter of the flange portion and greater than an outer diameter of the support device fixing portion In some implementations, the cover housing is manufactured by aluminum die-cast, and the discharge cover is made of a plastic material.

In some implementations, the discharge cover includes a cover flange configured to insert into an inner circumferential surface of the rear portion of the chamber portion, a seat portion that is bent from an inner edge of the cover flange and that is configured to seat the valve spring assembly, and a cover main body that extends from a front surface of the seat portion and that defines an accommodation portion configured to receive refrigerant that rias passed through the discharge valve. In some examples, the front surface of the seat portion is configured to contact the end portion of the dividing sleeve, where at least a portion of the cover main body is configured to insert into the dividing sleeve.

In some implementations, the fastening groove includes a pair or fastening grooves that are arranged at the outer circumferential surface of the support device fixing portion and that are spaced apart from each other by a predetermined angle about a center axis of the support device fixing portion. In some examples, the predetermined angle about the center axis of the support device fixing portion is between 90 and 120 degrees.

In some implementations, the discharge cover further includes a bottle neck portion that extends from a rear surface of the cover main body toward the valve spring assembly and that passes through the accommodation portion in the longitudinal direction of the shell.

In some implementations, since the refrigerant discharged from the discharge cover and guided to the inner space flows along the first guide groove and the second guide groove, and can be guided to the outer space through the communication groove, the flow path structure of the refrigerant can be simplified.

DETAILED DESCRIPTION

Reference will now be made in detail to the implementations of the present disclosure, examples of which are illustrated in the accompanying drawings.

Hereinafter, a linear compressor according to an implementation of the present disclosure will be described in detail with reference to the drawings.

Figure 1:
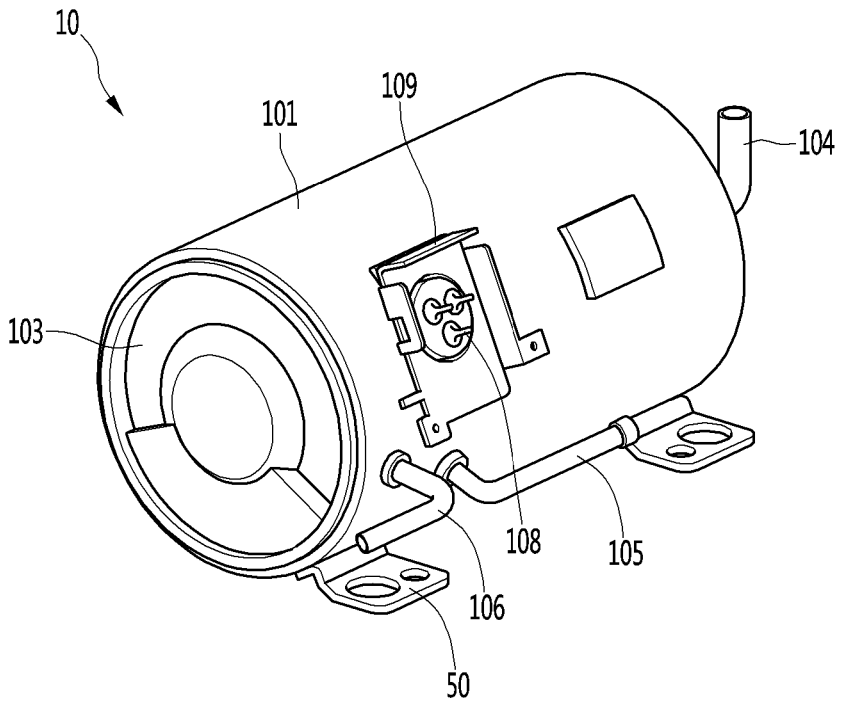
FIG. 1 is a perspective view illustrating an example linear compressor.

FIG. 1 is a perspective view of an example linear compressor according to a first implementation of the present disclosure.

With reference to FIG. 1, a linear compressor 10 may include a cylindrical shell 101 and a pair of shell covers coupled to both end portions of the shell 101. The pair of shell covers may include a first shell cover 102 (see FIG. 3) on a refrigerant suction side and a second shell cover 103 on a refrigerant discharge side.

In detail, the legs 50 can be coupled to the lower side of the shell 101. The legs 50 may be coupled to the base of the product in which the linear compressor 10 is installed. In one example, the product may include a refrigerator, and the base may include a machine room base of the refrigerator. As another example, the product may include an outdoor unit of the air conditioner, and the base may include a base of the outdoor unit.

The shell 101 has lying cylindrical shape and is advantageous in that the height of the machine room can be reduced when the linear compressor 10 is installed in the machine room base of the refrigerator. In other words, the longitudinal center axis of the shell 101 coincides with the central axis of the compressor main body, which will be described below, and the central axis of the compressor main body coincides with the central axis of the cylinder and the piston constituting the compressor main body.

A terminal block 108 may be installed on the outer surface of the shell 101. The terminal block 108 can be understood as a connecting portion for transmitting external power to the motor assembly 140 (see FIG. 3) of the linear compressor.

A bracket 109 is installed on the outside of the terminal 108. The bracket 109 may function to protect the terminal 108 from an external impact or the like.

Both end portions of the shell 101 are configured to be opened. The first shell cover 102 and the second shell cover 103 may be coupled to both opened end portions of the shell 101. By the shell covers 102 and 103, the inner space or the shell 101 can be sealed.

With reference to FIG. 1, the first shell cover 102 is located on the right side portion (or rear end portion) of the linear compressor 10, and the second shell cover 103 is located on the left side portion (or the front end portion) of the linear compressor 10. The end portion of the shell 101 on which the first shell cover 102 is mounted can be defined as the suction side end portion and the end portion of the shell 101 on which the second shell cover 103 is mounted can be defined as a discharge side end The linear compressor 10 may further include a plurality of pipes 104, 105, and 106 provided in the shell 101 or the shell covers 102 and 103. The refrigerant flows into the shell 101 through the plurality of pipes 104, 105, and 106, is compressed therein, and then is discharged to the outside of the shell 101.

In detail, the plurality of pipes 104, 105, and 106 may include a suction pipe 104 for allowing the refrigerant to be sucked into the linear compressor 10, a discharge pipe 105 for discharging the compressed refrigerant from the linear compressor 10, and a process pipe 106 for replenishing the linear compressor 10 with a refrigerant.

For example, the suction pipe 104 may be coupled to the first shell cover 102, and the refrigerant may be sucked into the linear compressor 10 along the axial direction through the suction pipe 104.

The discharge pipe 105 may be coupled to the outer circumferential surface of the shell 101. The refrigerant sucked through the suction pipe 104 can be compressed while flowing in the axial direction. The compressed refrigerant can be discharged to the outside through the discharge pipe 105. The discharge pipe 105 may be disposed at a position adjacent to the second shell cover 103 than the first shell cover 102.

The process pipe 106 may coupled to the outer circumferential surface of the shell 101. The operator can inject the refrigerant into the linear compressor 10 through the process pipe 106. The process pipe 106 may be coupled to the shell 101 at a different height than the discharge pipe 105 to avoid interference with the discharge pipe 105. The height may be defined as a distance reaching the discharge pipe 105 and the process pipe 106 from the leg 50 in the up and down direction (or the radial direction of the shell), respectively. The discharge pipe 105 and the process pipe 106 are coupled to the outer circumferential surface of the shell 101 at different heights, thereby facilitating the operation for injecting the refrigerant.

A cover support portion 102*a* (see FIG. 3) may be provided at the center of the inner surface of the first shell cover 102. A second support device 185, which will be described below, may be coupled to the cover support portion 102*a*. The cover support portion 102*a* and the second support device 185 can be understood as devices for supporting the rear end of the compressor main body so that the compressor main body maintains a horizontal state inside the shell 101. Here, the main body of the compressor refers set of components provided inside the shell 101, and may include, for example, a driving unit moving forward and backward and a support portion supporting the driving unit.

Figure 2:
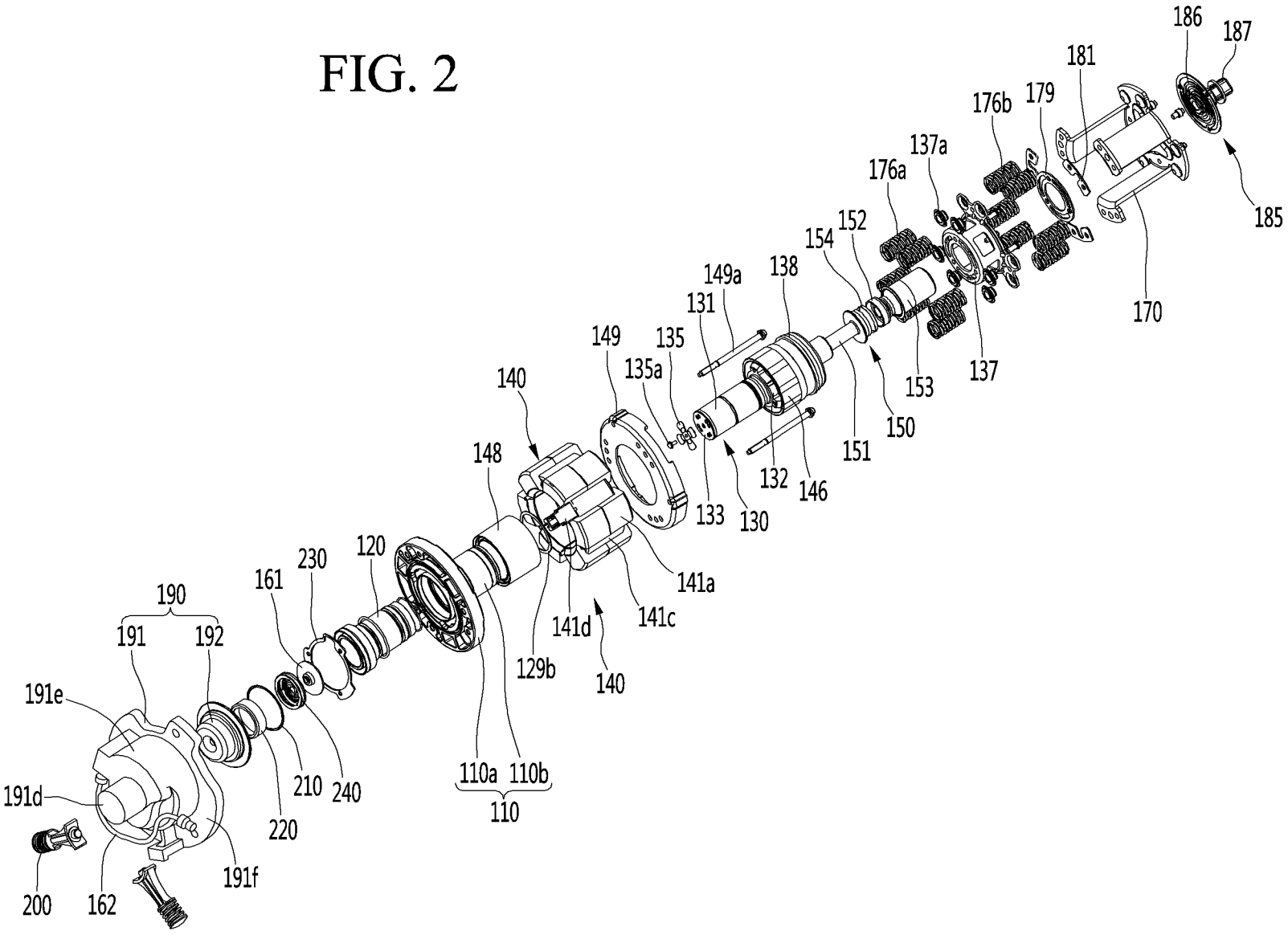
FIG. 2 is an exploded perspective view illustrating an example compressor main body accommodated in an example shell of the compressor.
Figure 3:
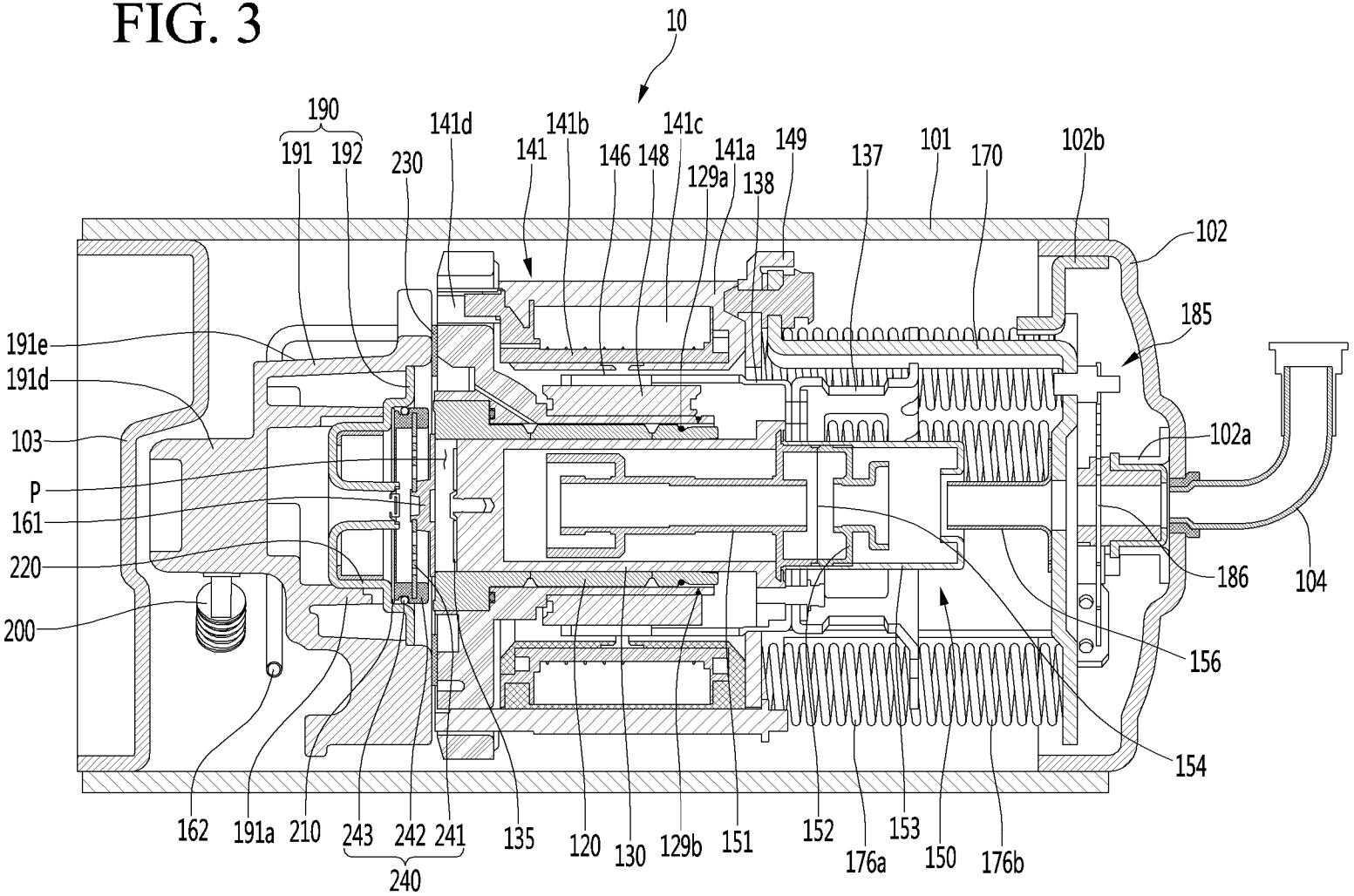
FIG. 3 is a longitudinal sectional view illustrating an example compressor.

The driving unit may include components such as a piston 130, a magnet frame 138, a permanent magnet 146, a supporter 137, and a suction muffler 150, as illustrated in FIGS. 2 and 3. The support portion may include components such as resonance springs 176*a* and 176*b*, a rear cover 170, stator cover 149, a first support device 200 and a second support device 185.

A stopper 102*b* (see FIG. 3) may be provided on the inner surface of the first shell cover 102 at an edge thereof. The stopper 102*b* is configured to prevent the main body of the compressor, in particular, the motor assembly 140 from being damaged by collision with the shell 101 due to shaking, vibration or impact generated during transportation of the linear compressor 10. Since the stopper 102*b* is located adjacent to a rear cover 170 to be described below so that when the linear compressor 10 is shaken, the rear cover 170 interferes with the stopper 102*b*, it is possible to prevent the impact from being directly transmitted to the motor assembly 140.

FIG. 2 is an exploded perspective view of an example compressor main body accommodated in an example shell of an example compressor, and FIG. 3 is a longitudinal sectional view of an example compressor.

With reference to FIGS. 2 and 3, the main body of the linear compressor 10 according to the implementation of the present disclosure provided inside the shell 101 includes a frame 110, a cylinder 120 which is fitted into a center of the frame 110, a piston 130 that reciprocates linearly in the cylinder 120, and a motor assembly 140 that applies a driving force to the piston 130. The motor assembly 140 may be a linear motor that linearly reciprocates the piston 130 in the axial direction of the shell 101.

In detail, the linear compressor 10 may further include a suction muffler 150. The suction muffler 150 is coupled to the piston 130 and provided to reduce noise generated from the refrigerant sucked through the suction pipe 104. The refrigerant sucked through the suction pipe 104 flows into the piston 130 through the suction muffler 150. For example, in the course of the refrigerant passing through the suction muffler 150, the flow noise of the refrigerant can be reduced.

The suction muffler 150 may include a plurality of mufflers. The plurality of mufflers may include a first muffler 151, a second muffler 152, and a third muffler 153 coupled to each other.

The first muffler 151 is positioned inside the piston 130 and the second muffler 152 is coupled to the rear end of the first muffler 151. The third muffler 153 accommodates the second muffler 152 therein, and the front end portion thereof may be coupled to the rear end of the first muffler 151.

The refrigerant sucked through the suction pipe 104 can pass through the third muffler 153, the second muffler 152, and the first muffler 151 in order from the viewpoint of the flow direction of the refrigerant. In this process, the flow noise of the refrigerant can be reduced.

A muffler filter 154 may be mounted on the suction muffler 150. The muffler filter 154 may be positioned at an interface at which the first muffler 151 and the second muffler 152 are coupled to each other. For example, the muffler filter 154 may have a circular shape, and an edge of the muffler filter 154 may be supported while disposing between the coupling surfaces of the first and second mufflers 151 and 152.

Here, "axial direction" can be understood as a direction coinciding with a reciprocating motion direction of the piston 130, that is, a direction in which the central axis of the cylindrical shell 101 in the longitudinal direction extends. In "axial direction", a direction from the suction pipe 104 toward the compression space P, that is, a direction in which the refrigerant flows is referred to as "frontward direction" and a direction opposite thereto is referred to as "rearward" direction". When the piston 130 moves forward, the compression space P can be compressed.

On the other hand, "radial direction" may be defined as a radial direction of the shell 101, and a direction orthogonal to a direction in which the piston 130 reciprocates.

The piston 130 may include a substantially cylindrical piston main body 131 and a piston flange portion 132 extending from the rear end of the piston main body 131 in the radial direction. The piston main body 131 reciprocates within the cylinder 120 and the piston flange portion 132 can reciprocate outside the cylinder 120. The piston main body 131 is configured to receive at least a portion of the first muffler 151.

In the cylinder 120, a compression space P in which the refrigerant is compressed by the piston 130 is formed. A plurality of suction holes 133 are formed at a point spaced apart from the center of the front surface portion of the piston main body 131 in the radial direction.

In detail, the plurality of suction holes 133 are arranged in the circumferential direction of the piston 130 to be spaced apart therefrom, and the refrigerant flows into the compression space P through the plurality of suction holes 133. The plurality of suction holes 133 may be spaced apart from each other at a predetermined interval the circumferential direction of the front surface portion of the piston 130 or may be formed of a plurality of groups.

In some implementations, a suction valve 135 for selectively opening the suction hole 133 is provided in front of the suction hole 133. The suction valve 135 is fixed to the front surface of the piston main body 131 by a fastening member **135*a*** such as a screw or a bolt.

In detail, on the other hand, in front of the compression space P, there are provided a discharge cover unit 190 for forming a discharge space tar the refrigerant discharged from the compression space P and a discharge valve assembly for discharging, refrigerant compressed in the compression space P to the discharge space.

The discharge cover unit 190 may be or de in a form in which a plurality of covers are stacked. A fastening hole or fastening groove **191*w* (see FIG. 8) for coupling the first support device 200**, which will be described below, may be formed on the outermost (or frontmost) one of the plurality of covers.

In detail, the discharge cover unit 190 includes a cover housing 191 fixed to the front surface of the frame 110 and a discharge cover 192 disposed inside the cover housing The discharge cover unit 190 may further include a cylindrical fixing ring 220 which is in close contact with the inner circumferential surface of the discharge cover 192. The fixing ring 220 is made of a material having a thermal expansion coefficient different from that of the discharge cover 192 to prevent the discharge cover 192 from being separated from the cover housing 191.

In other words, the stationary ring 220 is made of a material having a thermal expansion greater coefficient than that of the discharge cover 192 and is expanded while receiving heat from the refrigerant discharged from the compression space P, So that the discharge cover 192 can be strongly in close contact with the cover housing 191. Thus, the possibility that the discharge cover 192 is detached from the cover housing 191 can be reduced. For example, the discharge cover 192 may be made of high-temperature-resistant engineering plastic, the cover housing 191 may be made of aluminum die-cast, and the fixing ring 220 may be made of stainless steel.

In some implementations, the discharge valve assembly may include a discharge valve 161 and a valve spring assembly 240 that provides an elastic force in a direction in which the discharge valve 161 is in close contact with the front end of the cylinder 120.

In detail, the discharge valve 161 is separated from the front surface of the cylinder 120 when the pressure in the compression space P becomes equal to or higher than the discharge pressure, and the compressed refrigerant is discharged into the discharge space (or discharge chamber) which is formed in the discharge cover 192.

The valve spring assembly 240 may include a valve spring 242 in a form of a leaf spring, spring support portion 241 surrounding the edge of the valve spring 242 to support the valve spring 242, and a friction ring fitted to the outer circumferential surface the spring support portion 241.

When the pressure in the compression space P becomes equal to or higher than the discharge pressure, the valve spring 242 is elastically deformed toward the discharge cover 192 so that the discharge valve 161 is spaced apart from the front end portion of the cylinder 120.

The center of the front surface of the discharge valve 161 is fixedly coupled to the center of the valve spring 242 and the rear surface of the discharge valve 161 is in close contact with the front surface (or front end) of the cylinder 120 by the elastic force of the valve spring 242.

When the discharge valve 161 supported on the front surface of the cylinder 120, the compression space P is maintained in a closed state and when the discharge valve 161 is spaced apart from the front surface of the cylinder 120, the compression space P is opened so that the compressed refrigerant in the compression space P can be discharged.

The compression space P is understood as a space formed between the suction valve 135 and the discharge valve 161. The suction valve 135 is formed on one side of the compression space P and the discharge valve 161 is provided on the other side of the compression space P, that is, on the opposite side of the suction valve 135.

When the pressure of the compression space P becomes equal to or lower than the suction pressure of the refrigerant in a process of linearly reciprocating the piston 130 in the cylinder 120, the suction valve 135 is opened, and the refrigerant enters the compression space P.

On the other hand, when the pressure in the compression space P becomes equal to or higher than the suction pressure of the refrigerant, the suction valve 135 is closed and the refrigerant in the compression space P is compressed by advancing the piston 130.

In some implementations, when the pressure in the compression space P is larger than the pressure (discharge pressure) in the discharge space, the valve spring 242 is deformed forward and the discharge valve 161 is separated from the cylinder 120. The refrigerant in the compression space P is discharged into a discharge space formed in the discharge cover 192 through a spaced gap between the discharge valve 161 and the cylinder 120.

When the discharge of the refrigerant is completed, the valve spring 242 provides a restoring force to the discharge valve 161 so that the discharge valve 161 is in close contact with the front end of the cylinder 120 again.

In some implementations, a gasket 210 is provided on the Iron t surface of the spring support portion 241 so that, when the discharge valve 161 is opened, generation of noise by direct impact with the valve spring assembly 240 and the discharge cover while the valve spring as 240 is moved in the axial direction can be prevented.

In some implementations, the linear compressor 10 may further include a cover pipe 162. The cover pipe 162 is coupled to the cover housing 191 and discharges the refrigerant discharged from the compression space P to the discharge space inside the discharge cover unit 190 to the outside. To this end, one end of the cover pipe 162 is coupled to the cover housing 191 and the other end thereof is coupled to the discharge pipe 105 formed in the shell 101.

The cover pipe 162 is made of a flexible material and can extend roundly along the inner circumferential surface of the shell 101.

The frame 110 can be understood as a configuration for fixing the cylinder 120. For example, the cylinder 120 may be inserted in the axial direction of the shell 101 at the center portion of the frame 110. The discharge cover unit 190 may be coupled to the front surface of the frame 110 by a fastening member.

In some implementations, a heat insulating gasket 230 may be interposed between the cover housing 191 and the frame 110. In detail, the heat insulating gasket 230 is placed on the rear surface of the cover housing 191 or the front surface of the frame 110 in contact with the rear end so that conduction of the heat of the discharge cover unit 190 to the frame 110 can be minimized.

In some implementations, the motor assembly 140 may include an outer stator 141 fixed to the frame 110 so as to surround the cylinder 120, an inner stator 148 disposed to be spaced inward from the outer stator 141, and a permanent magnet 146 positioned in the space between the outer stator 141 and the inner stator 148.

The permanent magnets 146 can reciprocate linearly in the axial direction by the mutual electromagnetic force generated between the outer stator 141 and the inner stator 148. The permanent magnet 146 may be configured with a single magnet having one pole or a plurality of magnets having three poles.

The magnet frame 138 may have a cylindrical shape with a front surface opened and a rear surface closed. The permanent magnet 146 may be coupled to an end portion of the opened front surface of the magnet frame 138 or an outer circumferential surface of the magnet frame 138. A through-hole through which the suction muffler 150 passes may be formed at the rear center of the magnet frame 138 and the suction muffler 150 may be fixed to the rear surface of the magnet frame 138.

Specifically, the piston flange portion 132 extending in the radial direction from the rear end of the piston 130 is fixed to the rear surface of the magnet frame 138. The rear end edge of the first muffler 151 is interposed between the piston flange portion 132 and the rear surface of the magnet frame 138 and fixed to the center of the rear surface of the magnet frame 138.

When the permanent magnet 146 reciprocates in the axial direction, the piston 130 can reciprocate axially with the permanent magnet 146 as one body.

The outer stator 141 may include a coil winding body and a stator core 141*a*. The coil winding body includes a bobbin 141*b*, a coil 141*c* wound around the bobbin 141*b* in the circumferential direction, and a terminal portion 141*d* for guiding so that a power line connected to the coil 141*c* is pulled out or exposed to the outside of the outer stator 141.

The stator core 141*a* may include a plurality of core blocks formed by stacking a plurality of 'U'-shaped lamination plates in a circumferential direction. The plurality of core blocks may be arranged to surround at least a portion of the coil winding body.

A stator cover 149 is provided at one side of the outer stator 141. In detail, the front end portion of the outer stator 141 is fixed to the frame 110, and the stator cover 149 is fixed to the rear end portion thereof.

A bar-shaped cover-fastening member 149*a* passes through the stator cover 149 and is inserted and fixed to the frame 110 through an edge of the outer stator 141. In other words, the motor assembly 140 is stably fixed to the rear surface of the frame 110 by the cover-fastening member 149*a*.

The inner stator 148 is fixed to the outer periphery of the frame 110. The inner stator 148 is configured by stacking a plurality of lamination plates from the outside at the frame 110 in the circumferential direction.

In some implementations, the frame 110 may include a frame head 110*a* in the form of a disk and a frame body 110*b* extending from the center of the rear surface or the frame head 110*a* and accommodating the cylinder 120 therein. The discharge cover unit 190 is fixed to the front surface of the frame head 110*a* and the inner stator 148 is fixed to the outer circumferential surface of the frame body 110*b*. The plurality of lamination plates constituting the inner stator 148 are stacked in the circumferential direction of the frame body 110*b*.

The linear compressor 10 may further include a supporter 137 for supporting a rear end of the piston 130. The supporter 137 is coupled to the rear side of the piston 130 and a hollow portion may be formed inside the supporter 137 to allow the suction muffler 150 to pass therethrough.

The supporter 137 is fixed to the rear surface or the magnet frame 138. The piston flange portion 132, the magnet frame 138, and the supporter 137 are coupled to each other in one body together by the fastening member.

A balance weight 179 can be coupled to the supporter 137. The weight of the balance weight 179 may be determined based on the operating frequency range of the compressor main body.

The linear compressor 10 may further include a rear cover 170. The front end of the rear cover 170 is fixed to the stator cover 149 and extends rearward and is supported by the second support device 185.

In detail, the rear cover 170 may include three support legs, and the front surface portion (or the front end portion) of the three support legs may be coupled to the rear surface of the stator cover 149. A spacer 181 may be interposed between the three support legs and the rear surface of the stator cover 149. The distance from the stator cover 149 to the rear end portion of the rear cover 170 can be determined by adjusting the thickness of the spacer 181.

The linear compressor 10 may further include an inlet guide unit 156 coiled to the rear cover 170 and guiding the inflow of the refrigerant into the suction muffler 150. The front end portion of the inlet guide part 156 may be inserted into the suction muffler 150.

The linear compressor 10 may include a plurality of resonance springs whose natural frequencies are adjusted so that the piston 130 can resonate.

In detail, the plurality of resonance springs may include a plurality of first resonance springs 176*a* interposed between the supporter 137 and the stator cover 149 and a plurality of second resonance springs 176*b* interposed between the supporters 137 and the rear cover 170.

By the action of the plurality of resonance springs, a stable linear reciprocating motion of the piston 130 within the shell 101 of the linear compressor 10 enabled and the generation of vibration or noise caused by the movement of the piston 130 can be minimized.

The supporter 137 may include a spring insertion member 137*a* into which the rear end of the first resonance spring 176*a* is inserted.

The linear compressor 10 may include a plurality of sealing members for increasing a coupling force between the frame 110 and the components around the frame 110.

In detail, the plurality of sealing members may include a first sealing member 129*a* provided between the cylinder 120 and the frame 110 and a second sealing member 129*b* provided in a portion at which the frame 110 and the inner stator 148 are coupled.

The first and second sealing members 129*a* and 129*b* may be ring-shaped.

The linear compressor 10 may further include a pair of first support devices 200 for supporting the front end of the main body of the linear compressor 10. Specifically, one end of each of the pair of first support devices 200 is fixed to the discharge cover unit 190, and the other end is in close contact with the inner circumferential surface of the shell 101. The pair of second support apparatuses 200 supports the discharge cover unit 190 in a state of being opened at an angle ranging from 90 to 120 degrees.

In detail, the cover housing 191 constituting the discharge cover unit 190 may include a flange portion 191*f* tightly fixed to the front surface of the frame head 110*a*, a chamber portion 191*e* which is formed in the axial direction of the shell 101 from the inner edge of the flange portion 191*f*, a support device fixing portion 191*d* which extends further from the front surface of the chamber portion 191*e*, and a dividing sleeve 191*a* which extends inward of the chamber portion 191*e*.

The end portions of the pair of first support devices 200 are fixed to the outer circumferential surface of the support device fixing portion 191*d*, respectively. A fastening groove into which a fastening protrusion protruding from the front end portion of the first support device 200 is inserted may be formed on the outer circumferential surface of the support device fixing portion 191*d*.

In some implementations, the outer diameter of the support device fixing portion 191*d* may be smaller than the outer diameter of the front surface portion of the chamber portion 191*e*.

In some implementations, the linear compressor 10 may further include a second support device 185 for supporting a rear end of the compressor main body. The second support device 185 may include a second support spring 186 in the form of a circular leaf spring and a second spring support portion 187 that inserts into the center portion of the second support spring 186.

The outer edge of the second support spring 186 is fixed to the rear surface of the rear cover 170 by a fastening member and the second spring support portion 187 is coupled to the cover support portion 102*a* formed on the center of the first shell cover 102 and thus the rear end of the compressor main body is elastically supported at the center portion of the first shell cover 102.

Hereinafter, a discharge cover unit according to an implementation of the present disclosure will be described in detail with reference to the drawings.

Figure 4:
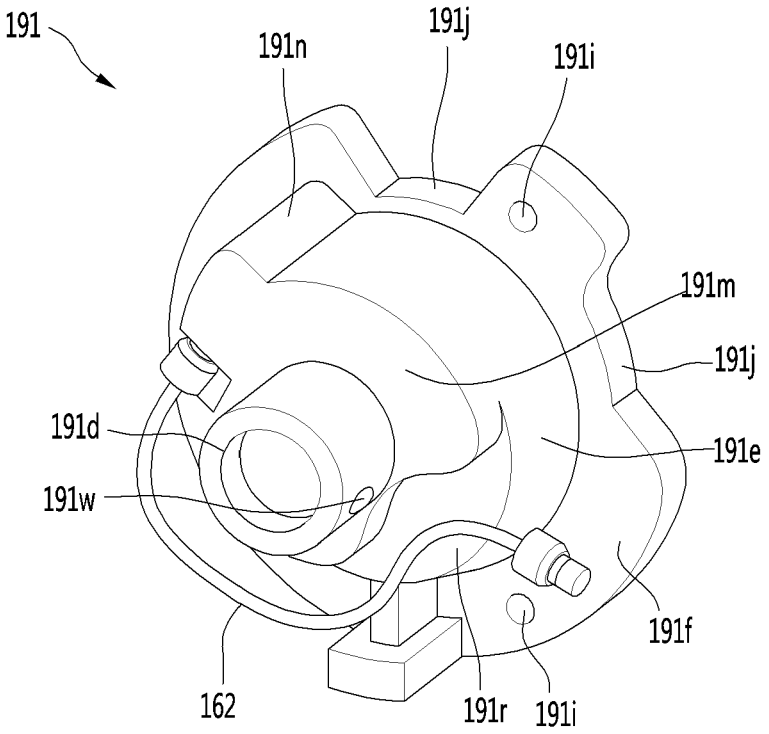
FIG. 4 is a perspective view illustrating an example cover housing.
Figure 5:
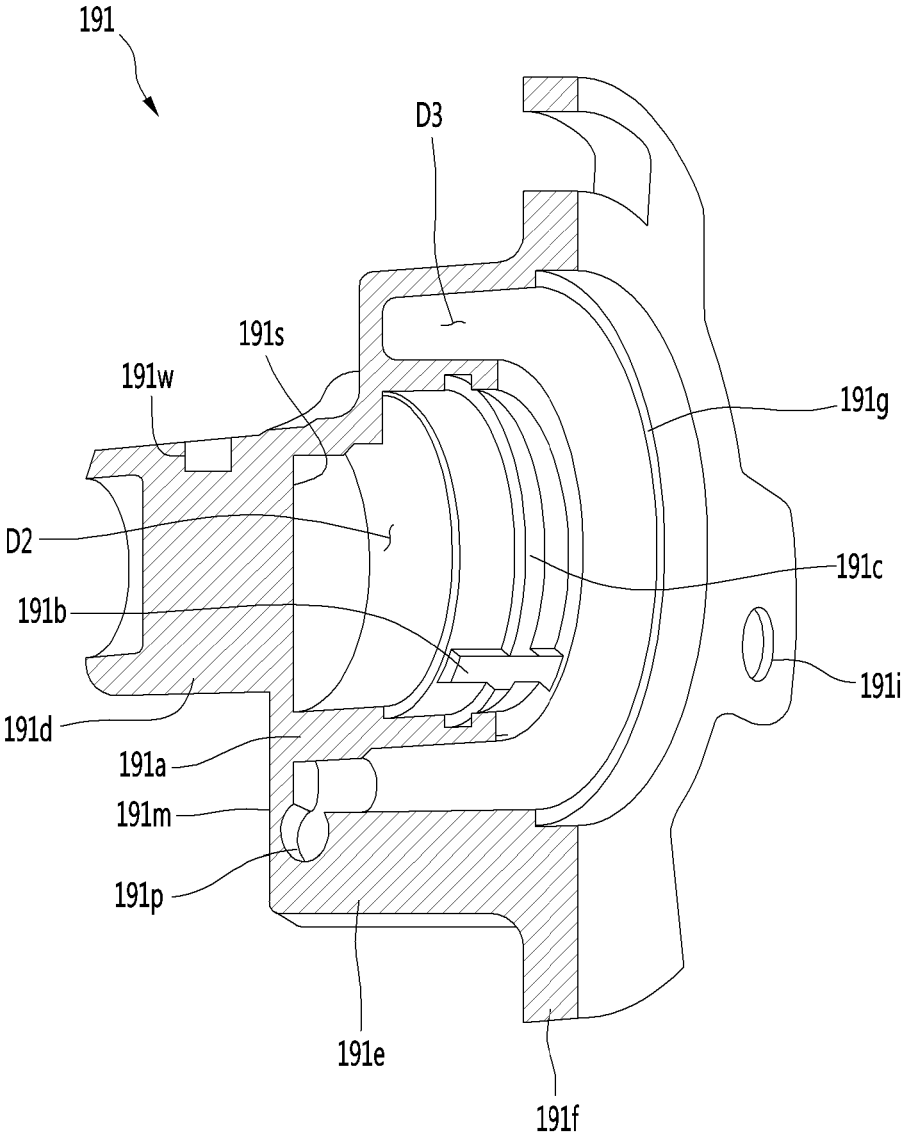
FIG. 5 is a partial cross-sectional perspective view illustrating an example cover housing.
Figure 6:
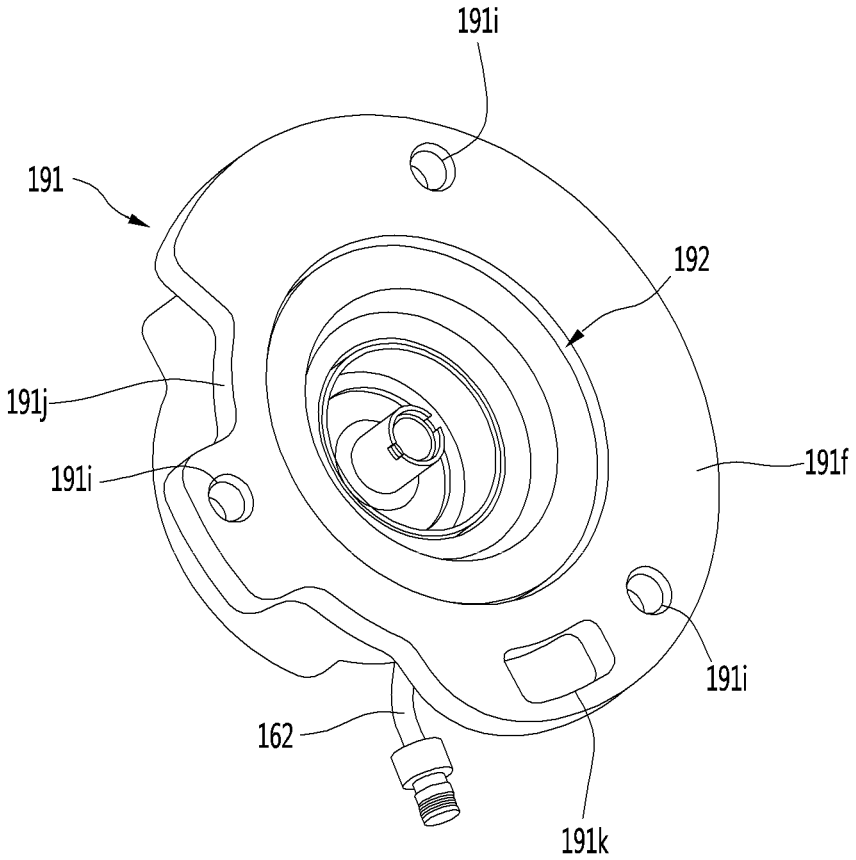
FIG. 6 is a perspective view illustrating a state where an example discharge cover and an example fixing ring are coupled to an example cover housing.
Figure 7:
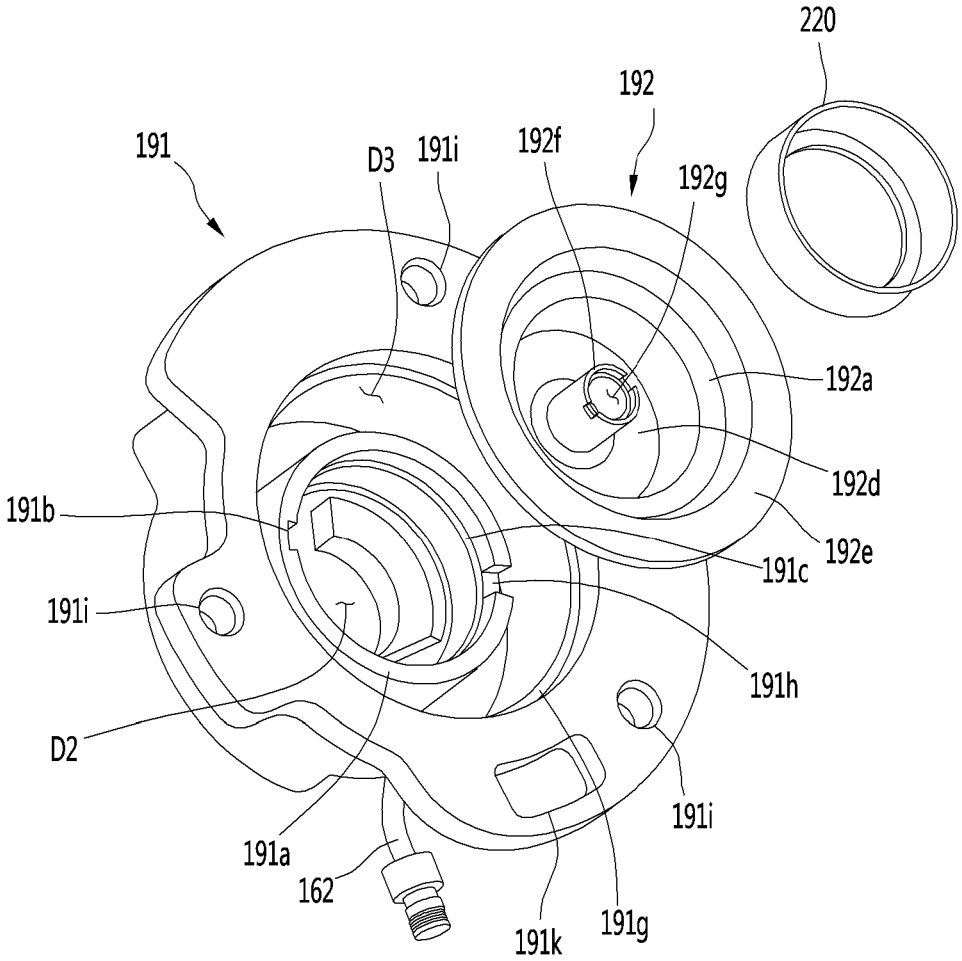
FIG. 7 is an exploded perspective view illustrating an example discharge cover unit.
Figure 8:
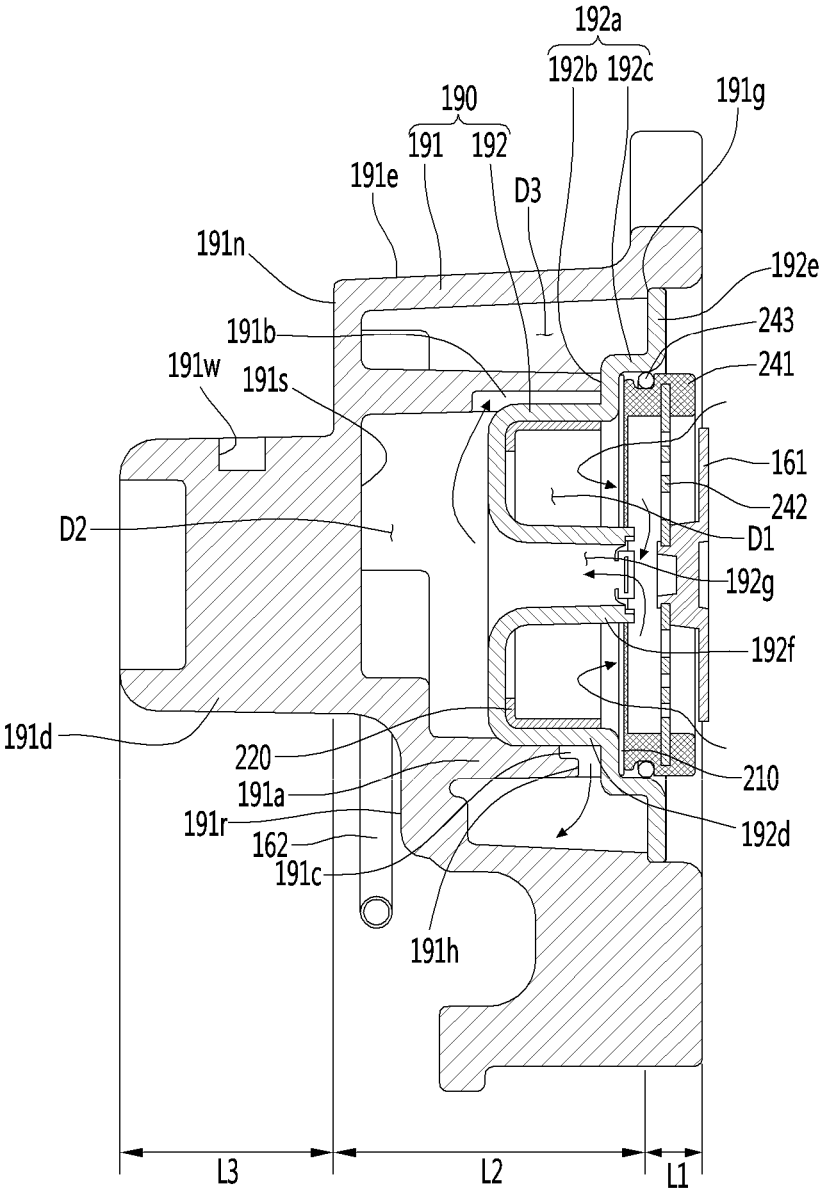
FIG. 8 is a longitudinal sectional view illustrating an example discharge cover unit.

FIG. 4 is a perspective view of an example cover housing, FIG. 5 is a partial cross-sectional perspective view of the cover housing, FIG. 6 is a perspective view illustrating a state where an example discharge cover and an example fixing ring are coupled to the cover housing, FIG. 7 is an exploded perspective view Illustrating an example discharge cover unit, FIG. 8 is a longitudinal sectional view illustrating the discharge cover unit.

With reference to FIGS. 4 to 8, the discharge cover unit 190 includes an outer cover housing 191, a discharge cover 192 mounted on the inside of the cover housing 191, and a fixing ring 220 fitted to the inner circumferential surface of the discharge cover.

On the other side, either one of the cover housing 191 and the discharge cover 192 may be defined as a first discharge cover 191 and the other one as a second discharge cover 192.

The cover housing 191 may be formed of die-cast aluminum, the discharge cover 192 may be formed of an engineering plastic, and the fixing ring 220 may be stainless steel. Further, the valve spring assembly 240 may be seated at the rear end of the discharge cover 192.

The cover housing 191 according to the implementation of the present disclosure is fixed to the front surface of the frame 110, and a refrigerant discharge space is formed therein.

For example, the cover housing 191 may have a container shape as a whole. In other words, the cover housing 191 forms a discharge space with the rear opened, and the discharge cover 192 can be inserted to shield the opened rear surface of the cover housing 191.

Particularly, the cover housing 191 according to the present disclosure is characterized in that it is integrally manufactured by aluminum die casting. Therefore, unlike the cover housing of the related art, the welding process can be omitted in the case of the cover housing 191 of the present disclosure. Therefore, the manufacturing process of the cover housing 191 can be simplified, resulting in minimization of product defects and cost reduction of the product. In some implementations, owing to the omission of the welding process, dimensional tolerance due to welding is remarkably reduced, so that there is no gap in the cover housing 191, and as a result, leakage of the refrigerant is prevented.

Specifically, with reference to FIGS. 4 and 5, the cover housing 191 includes a flange portion 191*f* which is tightly fixed to the front surface of the frame head 110*a*, a chamber portion 191*e* which extends in the axial direction of the shell 101 from the inner edge of the flange portion 191*f*, and a support device fixing portion 191*d* which further extends from the front surface of the chamber portion 191*e*.

The chamber portion and the support device fixing portion 191*d* may have a cylindrical shape. The outer diameter of the chamber portion 191*e* may be smaller than the outer diameter of the flange portion 191*f* and the outer diameter of the support device fixing portion 191*d* may be smaller than the outer diameter of the chamber portion 191*e*.

The flange portion 191*f* is bent at the rear end of the chamber portion 191*e* and is in close contact with the front surface or the frame head 110*a*. In other words, the flange portion 191*f* may extend outwardly from the rear end portion of the chamber portion 191*e*.

In other respects, the flange portion 191*f* may have a disk shape having a through-hole approximately at the center thereof. The through-hole may be circular.

In the flange portion 191*f*, a fastening hole 191*i* may be formed in the frame head 110*a* to be fastened by a fastening member.

A plurality of the fastening holes 191*i* may be disposed to be spaced apart from each other. For example, three fastening holes 191*i* may be formed and may be disposed at equal intervals in the circumferential direction of the flange portion 191*f*. In other words, the flange portion 191*f* is supported at three points on the frame head 110*a*, so that the cover housing 191 can be firmly fixed to the front surface of the frame 110.

In some implementations, a rotation preventing portion 191*j* may be formed on the outer circumferential surface of the flange portion 191*f* to prevent the cover housing 191 from rotating in a state where the cover housing 191 is mounted on the frame 110. The rotation preventing portion 191*j* may be formed so as to be recessed from the outer circumferential surface of the flange portion 191*f* toward the center of the flange portion 191*f*.

In some implementations, a rotation preventing hole 191*k* may be formed on the flange portion 191*f* to prevent the cover housing, 191 from rotating in a state where the cover housing 191 is mounted on the frame 110. The rotation preventing holes 191*k* may be formed to penetrate from the front surface to the rear surface of the flange portion 191*f*.

The chamber portion 191*e* extends in the axial direction of the shell 101 from the front surface of the flange portion 191*f*. Specifically, the chamber portion 191*e* may extend in the axial direction of the shell 101 from the inside of the through-hole formed in the flange portion 191*f*.

For example, the chamber portion 191*e* may extend in a hollow cylindrical shape. In some implementations, a discharge space through which the refrigerant flows may be provided in the chamber portion 191*e*.

A dividing sleeve 191*a* for dividing the inner space of the chamber portion 191*e* may be formed inside the chamber portion 191*e*.

The dividing sleeve 191*a* may extend in a cylindrical shape from the inside of the chamber portion 191*e*. Specifically, the dividing sleeve 191*a* may protrude rearward from the front surface 191*m* of the chamber portion 191*e*. The outer diameter of the dividing sleeve 191*a* is smaller than the outer diameter of the chamber portion 191*e*. Accordingly, the inner space of the chamber portion 191*e* can be divided by the dividing sleeve 191*a*.

On the other side, the dividing sleeve 191*a* may extend from the rear surface 191*s* of the front surface 191*m* of the chamber portion 191*e* to the rear of the chamber portion 191*e*.

In this implementation, the space corresponding to the inside of the dividing sleeve 191*a* is defined as a second discharge chamber D2, and the outer space of the dividing, sleeve 191*a* can be defined as a third discharge chamber D3. In other words, it can be determined that the discharge space of the chamber portion 191*e* is divided into the second discharge chamber r and the third discharge chamber D3 by the dividing sleeve 191*a*.

Herein, the second discharge chamber 192 may be referred to "inner space", and the third discharge chamber D3 may be referred to as "outer space".

In some implementations, a first guide groove 191*b* and a second guide groove 191*c* may be formed on the inner circumferential surface of the dividing sleeve 191*a*. The first guide groove 191*b* may extend in the longitudinal direction of the dividing sleeve 191*a* to have a predetermined width and length and the second guide groove 191*c* may extend in the circumferential direction of the dividing sleeve 191*a* and may be formed in a strip shape having a predetermined width and length.

In some implementations, the second guide groove 191*c* may be connected to the first guide groove 191*b* to communicate therewith. Therefore, the refrigerant guided to the second discharge chamber D2 can move in the axial direction (rearward) along the first guide groove 191*b* and in the circumferential direction along the second guide groove 191*c*.

In some implementations, the inner circumferential surface of the dividing sleeve 191*a* may be formed with a communication groove 191*h* having a depth from the end portion of the dividing sleeve 191*a* to the second guide groove 191*c* in a stepped manner. The communication groove 191*h* communicates with the second guide groove 191*c*.

The communication groove 191*h* can be understood as a passage through which the refrigerant moved in the circumferential direction along the second guide groove 191*c* flows into the third discharge chamber D3.

The communication groove 191*h* may be formed at a position spaced apart from the first guide groove 191*b* in the circumferential direction of the dividing sleeve 191*a*. For example, the communication groove 191*h* may be formed at a position opposite to or facing the first guide groove 191*b*. Therefore, since the time taken for the refrigerant flowing into the second guide groove 191*c* to stay in the second guide groove 191*c* can increase, the pulsation noise of the refrigerant can be effectively reduced.

The first guide groove 191*b* is illustrated as being recessed from the inner circumferential surface of the dividing sleeve 191*a* and extending to the end portion of the dividing sleeve 191*a*. However, in reality, the refrigerant guided to the second discharge chamber D2 may not flow into the second discharge chamber D2 through the first guide groove 191*b*. In other words, when the discharge cover 192 is in close contact with the inside of the cover housing 191, the end portion of the first guide groove 191*b* may be shielded by the outer surface of the discharge cover 192.

However, the first guide groove 191*b* may inevitably extend to the end portion of the dividing sleeve 191*a* due to the aluminum die casting process.

Further, the chamber portion 191*e* may further include a pipe coupling portion 191*n* to which the cover pipe 162 is coupled.

The pipe coupling portion 191*n* may protrude from the outer circumferential surface of the chamber portion 191*e*. A seating groove for seating the cover pipe 162 is formed in the pipe coupling portion 191*h*.

An insertion groove 191*p* for inserting an entrance end of the cover pipe 162 is formed in the seating groove. In some implementations, the insertion groove 191*p* may communicate with the third discharge chamber D3.

Therefore, when the cover pipe 162 is inserted into the insertion groove 191*p*, the refrigerant in the third discharge chamber D3 can be guided to a side of the cover pipe 162. The refrigerant guided to the cover pipe 162 may be discharged to the outside of the compressor through the discharge pipe 105.

In some implementations, the chamber portion 191*e* may further include a recessed portion 191*r* for avoiding interference with the cover pipe 162 in a state where the cover pipe 162 is coupled to the pipe coupling portion 191*n*.

The recessed portion 191*r* functions to prevent the cover pipe 162 from being in contact with the front surface 191*m* of the chamber portion when the cover pipe 162 is inserted into the insertion groove 191*p*. In this end, the recessed portion 191*r* may be recessed rearward from a part of the front surface 191*m* of the chamber portion. In other words, the recessed portion 191*r* may be stepped from the front surface 191*m* of the chamber portion.

The support device fixing portion 191*d* extends in the axial direction of the shell 101 from the front surface 191*m* of the chamber portion. Specifically, the support device fixing portion 191*d* may extend from the front surface 191*m* of the chamber portion to a cylindrical shape having an outer diameter smaller than that of the chamber portion 191*e*.

The end portions of the pair of first support devices 200 are respectively coupled to the outer circumferential surfaces of the support device fixing portions 191*d*. To this end, a fastening groove 191*w* in which a fastening protrusion protruding from the front end portion of the first support device 200 is inserted is formed on the outer circumferential surface of the support device fixing portion 191*d*.

Specifically, as the fastening groove 191*w*, a pair of fastening groove 191*w* for coupling a pair of first support devices 200 are formed on a side surface portion of the support device fixing portion 191*d*, that is, a surface forming a cylindrical portion (hereinafter referred to as a circumferential surface). The pair of fastening grooves 191*w* may be formed at a predetermined angle along the circumferential surface of the support device fixing portion 191*d*. The fastening groove 191*w* may be formed to penetrate from the circumferential surface of the support device fixing portion 191*d* toward the central portion of the support device fixing portion 191*d*. For example, the fastening groove 191*w* may have a circular cross-sectional shape but is not limited thereto.

In some implementations, with reference to FIG. 8, a length L2 in the transverse direction in which the chamber portion 191*e* extends forward may be longer than a length L3 in the transverse direction in which the support device fixing portion 191*d* extends forward. In other words, the length L2 from the rear end portion to the front end portion of the chamber portion 191*e* may be longer than the length L3 from the rear end portion to the front end portion of the support device fixing portion 191*d*. Therefore, the chamber portion 191*e* can secure a discharge space sufficient to reduce the pulsation noise of the refrigerant.

A length L1 from the rear end portion to the front end portion of the flange portion 191*f* is shorter than the length L3 from the front end portion of the chamber portion 191*e* to the front end portion of the support device fixing portion 191*d*.

A hooking jaw 191*g* may be formed on the inner circumferential surface of the rear end portion of the chamber portion 191*e* so that the rear end portion of the discharge cover 192 is hooked.

With reference to FIGS. 6 to 8, the discharge cover 192 will be described in detail.

The discharge cover 192 may include a flange 192*e* whose outer edge is caught by the hooking jaw 191*g*, a seat portion bent at the inner edge of the flange 192*e* to seat the valve spring assembly 240, a cover main body 192*d* extending from the front surface of the seat portion 192*a*, and a bottle neck portion 192*f* extending from a central portion of the cover main body 192*d* to an inner space of the cover main body 192*d*. Here, the flange 192*e* of the discharge cover 192 may be referred to as "cover flange".

In detail, the flange 192*e* is a member inserted into the hooking jaw 191*g* formed in the cover housing 191. In one example, the flange 192*e* may be formed as a hollow circular or oval shape. The flange 192*e* is fitted inside the rear end portion of the chamber portion 191*e*.

The seat portion 192*a* may include a second portion 192*c* that is bent forward at the inner edge of the flange 192*e* and a first portion 192*b* that is bent at the front end of the second portion 192*c* toward the center of the discharge cover 192. The cover main body 192*d* may be bent forward at the inner edge of the first portion 192*b* and then bent toward the center of the discharge cover 192.

On the other side, The sectional structure of the discharge cover 192 can he described as below, that is, the bottle neck portion 192*f* extends from the center of the front surface of the cover main body 192*d* to the inside of the discharge cover 192 and is radially extended from the rear end portion of the cover main body 192*d* in the radial direction, the second portion 192*c* extends in the axial direction from the outer edge of the first portion 192*b* and the flange 192*e* extends from the rear end of the second portion 192*c* in the radial direction.

The in space of the cover main body 192*d* may define a first discharge chamber D1 and a discharge hole 192*g* through which the refrigerant discharged from the first discharge chamber DI passes.

Here, the first discharge chamber D1 may be referred to as "receiving portion".

In detail, when the discharge cover 192 is inserted into the cover housing 191, the front surface of the seat portion 192*a* is in contact with the end portion of the dividing sleeve 191*a*. In some implementations, the second discharge chamber D2 can be shielded by being the front surface of the seat portion 192*a* in close contact with the end portion of the dividing sleeve 191*a*.

However, since the communication groove 191*h* formed at the end of the dividing sleeve 191*a* is spaced apart from the seat portion 192*a*, the refrigerant guided to the second discharge chamber D2 moves the third discharge chamber D3 through the communication groove 191*h*.

The outer circumferential sur ace of the cover main body 192*d* may be spaced apart from the first guide groove 191*b* by a predetermined distance. Therefore, the refrigerant guided to the second discharge chamber D2 can be guided to the first guide groove 191*b* and flow into the second guide groove 191*c*.

In some implementations, the front surface of the valve spring assembly 240 is seated on the first portion 192*b* and the friction ring 243 is in contact with the second portion 192*c* to generate a frictional force.

The depth and/or width of the friction ring seating groove are formed to be smaller than the diameter of the friction ring 243 so that the outer edge of the friction ring 243 protrudes from the outer circumferential surface of the spring support portion 241. Then, when the valve spring assembly 240 is seated on the seat portion 192*a*, the friction ring 243 is pressed by the second portion 192*c* to deform the circular cross-section into an elliptical cross-section, as a result, a predetermined frictional force may be generated while the contact area with the second portion 192*c* becomes wider. Thereby a gap is not formed between the second portion 192*c* and the outer circumferential surface of the spring support portion 241, and the frictional force prevents the valve spring assembly 240 from idling in the circumferential direction.

In some implementations, since the spring support portion 241 does not directly hit the discharge cover 192, specifically, the second portion 192*c* by the friction ring 243, the generation of impact noise can be minimized.

In some implementations, the gasket 210 is interposed between the first portion 192*b* and the front surface of the spring support portion 241 to prevent the spring support portion 241 from directly hitting the first portion 192*b*.

The outer edge of the valve spring 242 is inserted into the spring support portion 241 and the outer edge or the valve spring 242 may be positioned at a position closer to the rear surface than the front surface of the spring support portion 241. The front center portion of the discharge valve 161 may be inserted into the center of the valve spring 242.

In some implementations, the refrigerant discharged from the compression space P by the opening of the discharge valve 161 passes through slits formed in the valve spring 242 and is guided to the first discharge chamber D1. For example, to open the discharge valve 161, the discharge valve 161 may move in a direction approaching the rear end of the bottle neck portion 192*f* by elastic deformation of the valve spring 242, and the front surface of the compression space E may be opened.

The refrigerant guided to the first discharge chamber D1 is guided to the second discharge chamber D2 through a discharge hole 192*g* formed at the rear end of the bottle neck portion 192*f*. In this case, since the discharge hole is formed in the bottle neck portion 192*f* as compared with the structure in which the discharge hole is formed on the front surface of the cover main body 192*d*, the pulsation noise of the refrigerant can be remarkably reduced. In other words, the refrigerant in the first discharge chamber D1 is discharged to the second discharge chamber D2 having a large cross-sectional area after passing through the bottle neck portion 192*f* having a narrow cross-sectional area, and the noise due to pulsation of the refrigerant is remarkably reduced.

In some implementations, the refrigerant guided to the second discharge chamber D2 moves in the axial direction along the first guide groove 191*b* and moves in the circumferential direction along the second guide groove 191*c*. The refrigerant moving in the circumferential direction along the second guide groove 191*c* is guided to the third discharge chamber D3 through the communication groove 191*h*.

Here, in a process of discharging the refrigerant which flows along the first guide groove 191*b*, the second guide groove 191*c*, and the communication groove 191*h* having a narrow cross-sectional area to the third discharge chamber D3 having a large sectional area, the pulsation noise of the refrigerant is reduced once more.

The refrigerant guided to the third discharge chamber D3 is discharged to the outside of the compressor through the aver pipe 162.

Figure 9:
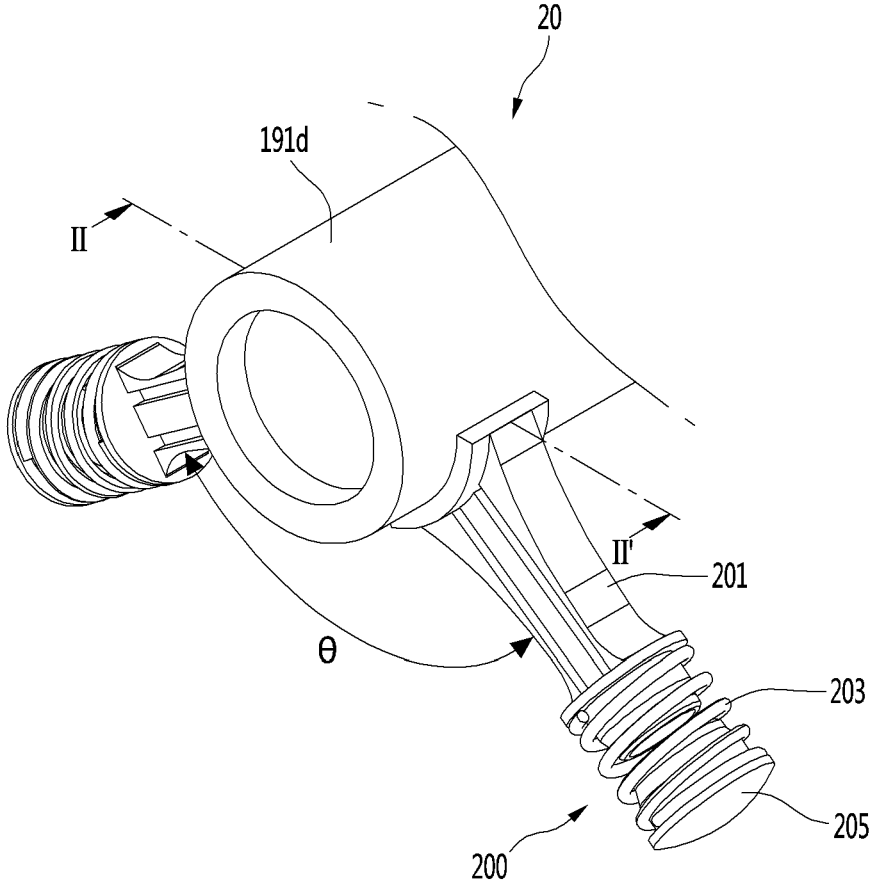
FIG. 9 is a front portion perspective view illustrating an example first support device that supports a front end of an example compressor main body of an example linear compressor.
Figure 10:
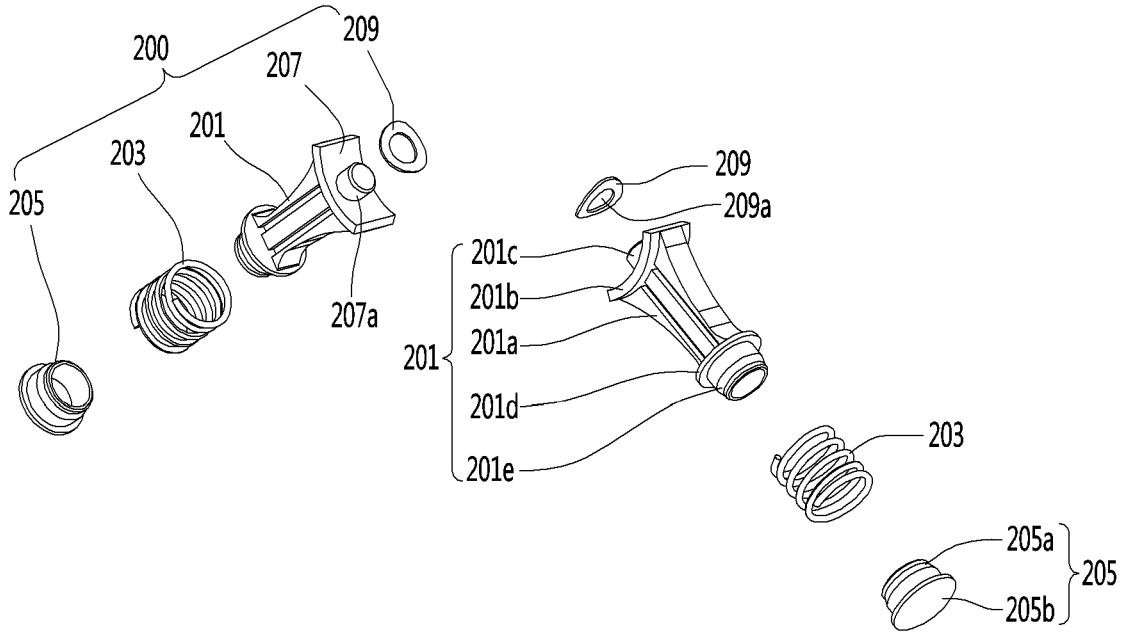
FIG. 10 is an exploded perspective view illustrating an example first support device.
Figure 11:
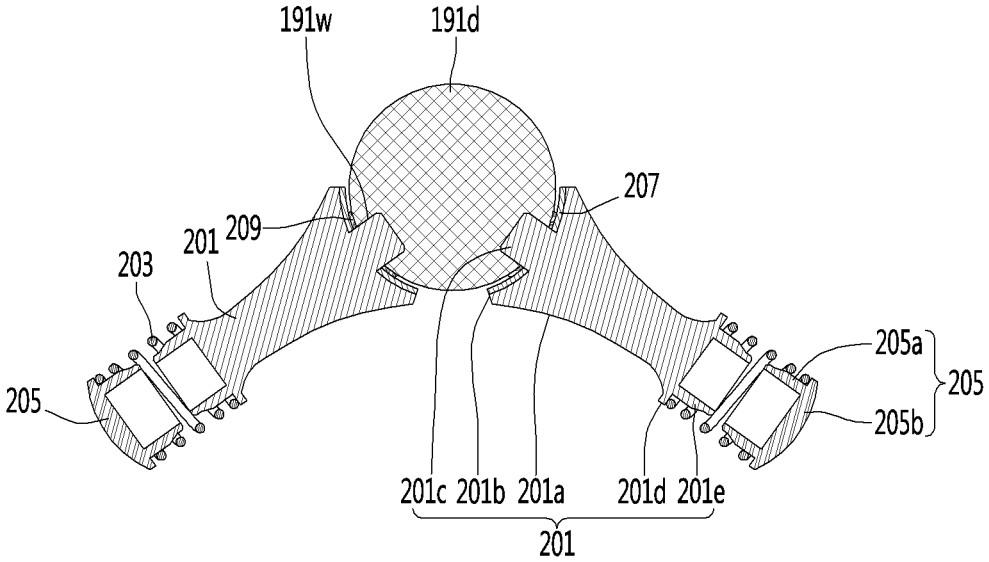
FIG. 11 is a longitudinal sectional view taken along line II-II' of FIG. 9.

FIG. 9 is a front portion perspective view illustrating an example first support device for supporting a front end of the compressor main body of the linear compressor, FIG. 10 is an exploded perspective view illustrating the first support device, and FIG. 11 is a longitudinal sectional view taken along line II-II' of FIG. 9.

With reference to FIGS. 9 to 11, the first support device 200 according to the present implementation includes a pair of damper units.

The pair of damper units is tightly coupled to the circumferential surface of the support device fixing portion 191*d*. Specifically, the pair of damper units is respectively coupled to the pair of fastening grooves 191*w* in the tangential direction orthogonal to the circumferential surface of the support device fixing portion 191*d*. The angle (θ) formed by the pair of damping units may be in the range of 90 to 120 degrees, and preferably 108 degrees.

In some implementations, each of the pair of damper units may include a support leg 201 which is formed to be elongated in the up and down direction and a cushion pad 207 which is placed on the upper surface of the support leg 201 and is in close contact with the support device fixing portion 191*d*, an elastic member 203 whose one end portion is fitted to the lower end of the support leg 201, and a shell seat which is fitted to the other end of the elastic member 203 and which is seated on the inner circumferential surface of the shell 101.

The elastic member 203 includes a coil spring, and the cushion pad 207 may be made of rubber, silicone, or plastic material.

The support leg 201 may include a leg main body 201*a*, a head support portion 201*b*, a fastening protrusion 201*c*, a flange 201*d*, and an extension portion 201*e*.

In detail, the leg main body 201*a* may have a bar shape or a column shape that is long in the up and down direction example, the leg main body 201*a* may have a larger horizontal cross-sectional area from the lower portion to the upper portion. Therefore, the leg main body 201*a* can more strongly support the support device fixing portion 191*d*.

The head support portion 201*b* may be rounded at a curvature corresponding to the curvature of the circumferential surface of the support device fixing portion 191*d* at the upper end of the leg main body 201*a*. The cushion pad 207 is stacked on the upper surface of the head support portion 201*b*, and the upper surface of the head support portion 201*b* is in close contact with the circumferential surface of the support device fixing portion 191*d* by the cushion pads 207.

In some implementations, side cushion pads 207*a* may be disposed on an outer surface of the fastening protrusion 201*c*.

The fastening protrusion 201*c* protrudes from the center of the upper surface of the support portion 201*b* by a predetermined length and is inserted into the fastening groove 191*w* of the support device fixing portion 191*d*. In other words, the fastening protrusion 201*c* can be understood as a member for the support leg 201 to be mounted on the cover housing 191. The flange 201*d* extends in the form of a circular rib at the lower end of the leg main body 201*a*.

The extension portion 201*e* may have a diameter smaller than the diameter of the flange 201*d* at the bottom of the flange 201*d* and may extend to a predetermined length. In some implementations, the extension portion 201*e* may have a hollow sleeve shape. The extension portion 201*e* is inserted into the elastic member 203 and one end portion of the elastic member 203 is seated on the flange 201*d*.

The shell sheet 205 may include a bottom portion 205*b* being in close contact with the inner circumferential surface of the shell 101 and a support sleeve 205*a* extending from the upper surface of the bottom portion 205*b*. The outer diameter of the support sleeve 205*a* may be smaller than the outer diameter of the bottom 205*b*.

The support sleeve 205*a* is inserted into the elastic member 203 and the other end portion of the elastic member 203 is seated on the upper surface of the bottom 205*b*. The lower surface of the bottom portion 205*b* may be rounded in the center. For example, the lower surface of the bottom portion 205*b* may have a curvature corresponding to the curvature of the inner circumferential surface of the shell 101.

The cushion pads 207 are formed in a plate shape having a predetermined area and placed on the upper surface of the head support portion 201*b*. A through-hole 209*a* through which the fastening protrusion 201*c* passes is formed in the center of the cushion pad 207.

Ear example, the cushion pad 207 may have the same shape and size as those of the upper surface of the head support portion 201*b*. In other words, when the cushion pad 207 is fitted in the fastening protrusion 201*c*, the upper surface of the head support portion 201*b* may be provided in a shape completely covered by the cushion pad 207.

In the present implementation or in other implementations, the cushion pads 207 may have a rectangular shape with a through-hole 209*a* formed at the center thereof but may have an elliptical or circular ring shape. In other words, the shape and size of the cushion pad 207 are not limited.

In some implementations, each of the pair of damper units may further include a washer 209 which is in close contact with the upper surface of the cushion pad 207. In a state where the support leg 201 is inserted into the fastening groove 191*w* of the support device fixing portion 191*d*, the washer 209, together with the cushion pad 207, performs a function of preventing rotation of the support leg 201.

The washer 209 may be made of rubber, silicone, or plastic material, and may have a hollow ring shape. A through-hole 209*a* is formed at the center of the washer 209 and the through-hole 209*a* is fitted in the fastening protrusion 201*c*.

For example, the cushion pads 207 may be first fitted into the fastening protrusions 201*c*, and the washers 209 may be secondarily inserted. Thus, in the state where the support leg 201 is inserted into the support device fixing portion 191*d*, the phenomenon of idling is prevented and the fastening force can be improved.

In some examples, in a state where the extension portion 201*e* of the support leg 201 and the support sleeve 205*a* of the shell sheet 205 are inserted into both end portions of the elastic member 203, the extension portion 201*e* and the support sleeves 205*a* remain separated from each other without being in contact with each other. When the linear compressor 10 is driven and vibration is transmitted to the support device fixing portion 191*d*, the extension portion 201*e* and the support sleeve 205*a* move closer to each other and move away from each other repeatedly by the stretching action of the elastic member 203.

Here, it is preferable that the elastic modulus of the elastic member 203 is appropriately set so that the extension portion 201*e* and a case where the support sleeve 205*a* are in contact with each other and impact noise is generated in the process of generating vibration is not generated.

In some implementations, since the pair of damping units connect the support device fixing portion 191*d* and the shell 101 in a reverse 'V' shape as illustrated in the drawing, not only the compressor main body is stably supported, the damping unit and the support device fixing portion 191*d* can be stably connected to each other without using a fastening member such as a screw. Further, since a separate fastening member is not required even in a connection portion between the damping unit and the shell 101, the number of components is reduced and the compressor main body can be easily supported.

The linear compressor according to the implementation of the present disclosure configured as described above has the following effects.

Firstly, since the cover housing for forming the discharge space of the refrigerant is integrally manufactured by the aluminum die casting, the welding process can be omitted, thereby shortening the working time and facilitating the dimension management.

Secondly, since on the inside of the cover housing, there is provided a dividing sleeve which divides the discharge space into a plurality of discharge spaces, the discharge cover is assembled so as to shield the dividing sleeve, and thus a large number of discharge spaces can be provided, the number of components is reduced and the discharge cover is easily assembled.

Thirdly, since a first guide groove formed in the longitudinal direction of the dividing sleeve and a second guide groove formed in the circumferential direction of the dividing sleeve are formed on the inner circumferential surface of the dividing sleeve to increase the time during which the refrigerant stays in the cover housing, the pulsation noise of the refrigerant can be effectively reduced.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a shell;

a frame located inside of the shell, the frame comprising a frame head and a frame body that extends from a center of a rear surface of the frame head in a longitudinal direction of the shell;

a cylinder located inside of the frame body and inserted into the frame body through the frame head, the cylinder defining a compression space in a front end portion of the cylinder;

a piston located inside of the cylinder and configured to move relative to the cylinder;

a motor assembly configured to drive the piston to move in an axial direction of the cylinder to compress refrigerant in the compression space;

a discharge cover unit that is configured to couple to a front surface of the frame and that defines a discharge space configured to receive refrigerant discharged from the compression space;

a discharge valve located at a front surface of the cylinder and configured to selectively open and close the compression space; and a valve spring assembly inserted into the discharge cover unit and configured to provide elastic force that causes the discharge valve to contact the front surface of the cylinder, wherein the discharge cover unit includes:

a cover housing that defines the discharge space, the cover housing having a rear surface configured to couple to a front surface of the frame head, a dividing sleeve that is disposed in an inside of the cover housing, that protrudes rearward from an inner surface of the cover housing toward the front surface of the cylinder, and that divides the discharge space into a plurality of discharge chambers including an inner chamber and an outer chamber, and a discharge cover that is inserted into the inside of the cover housing and contacts at least a portion of a rear end portion of the dividing sleeve within the inside of the cover housing.

2. The linear compressor according to claim 1, wherein the cover housing defines an opening at the rear surface of the cover housing, the rear surface of the cover housing defining the discharge space at the inside of the cover housing, and wherein the discharge cover is configured to cover the opening defined at the rear surface of the cover housing.

3. The linear compressor according to claim 1, wherein the cover housing includes:

a chamber portion having a front portion that is closed and a rear portion that is opened, the chamber portion extending in the longitudinal direction of the shell and defining the discharge space; and a flange portion that is bent from a rear end of the chamber portion and that is configured to contact the front surface of the frame head, and wherein the dividing sleeve extends from a rear surface of the front portion of the chamber portion toward the rear portion of the chamber portion.

4. The linear compressor according to claim 3, wherein the dividing sleeve has a cylindrical shape, and wherein an outer diameter of the dividing sleeve is less than an inner diameter of the chamber portion.

5. The linear compressor according to claim 4, wherein the inner chamber is located at an inner side of the dividing sleeve, and the outer chamber is located at an outer side of the dividing sleeve, and wherein the dividing sleeve defines a guide groove that is located at an inner circumferential surface of the dividing sleeve and that is configured to guide refrigerant from the inner chamber to the outer chamber.

6. The linear compressor according to claim 5, wherein the guide groove includes:

a first guide groove that extends from the inner circumferential surface of the dividing sleeve in a longitudinal direction of the dividing sleeve; and a second guide groove that extends in a circumferential direction of the dividing sleeve and that is connected to the first guide groove.

7. The linear compressor according to claim 6, further comprising a communication groove that is recessed from the rear end portion of the dividing sleeve and that extends to the second guide groove, wherein the discharge cover is configured to discharge refrigerant to the inner chamber, and wherein the first guide groove and the second guide groove are configured to guide refrigerant from the inner chamber to the outer chamber through the communication groove.

8. The linear compressor according to claim 7, wherein the communication groove is spaced apart from the first guide groove in the circumferential direction of the dividing sleeve.

9. The linear compressor according to claim 3, further comprising a cover pipe that is configured to couple to the chamber portion and that is configured to discharge refrigerant from the discharge space to an outside of the cover housing.

10. The linear compressor according to claim 9, wherein the chamber portion defines a recessed portion that is recessed from the front portion of the chamber portion and that allows the cover pipe to avoid interference with the chamber portion.

11. The linear compressor according to claim 3, wherein the cover housing further includes a support device fixing portion that extends forward from a front surface of the chamber portion in the longitudinal direction of the shell and that defines a fastening groove at an outer circumferential surface of the support device fixing portion, and wherein the outer circumferential surface of the support device fixing portion is configured to connect to an inner circumferential surface of the shell based on insertion of a support device into the fastening groove.

12. The linear compressor according to claim 11, wherein the support device includes a pair of damping units, each damping unit having a first end portion configured to connect to the outer circumferential surface of the support device fixing portion and a second end portion configured to connect to the inner circumferential surface of the shell, wherein each damping unit includes:

a support leg, a cushion pad configured to be positioned between an upper-end portion of the support leg and the support device fixing portion, an elastic member having a first end portion supported by a lower end portion of the support leg, and a shell sheet coupled to a second end portion of the elastic member.

13. The linear compressor according to claim 12, wherein the support leg includes:

a leg main body that extends toward the inner circumferential surface of the shell by a predetermined length;

a head support portion that is located at an upper-end portion of the leg main body, that has a round shape, and that is configured to contact the outer circumferential surface of the support device fixing portion; and a fastening protrusion that protrudes from a center of the head support portion and that is inserted into the fastening groove of the support device fixing portion through the cushion pad.

14. The linear compressor according to claim 11, wherein an outer diameter of the chamber portion is less than an outer diameter of the flange portion and greater than an outer diameter of the support device fixing portion.

15. The linear compressor according to claim 1, wherein the cover housing is manufactured by aluminum die-cast, and wherein the discharge cover is made of a plastic material.

16. The linear compressor according to claim 3, wherein the discharge cover includes:

a cover flange inserted into an inner circumferential surface of the rear portion of the chamber portion;

a seat portion that is bent from an inner edge of the cover flange and that is configured to seat the valve spring assembly; and a cover main body that extends from a front surface of the seat portion and that defines an accommodation portion configured to receive refrigerant that has passed through the discharge valve.

17. The linear compressor according to claim 16, wherein the front surface of the seat portion is configured to contact the rear end portion of the dividing sleeve, and wherein at least a portion of the cover main body is inserted into the dividing sleeve.

18. The linear compressor according to claim 12, wherein the fastening groove comprises a pair of fastening grooves that are arranged at the outer circumferential surface of the support device fixing portion and that are spaced apart from each other by a predetermined angle about a center axis of the support device fixing portion.

19. The linear compressor according to claim 18, wherein the predetermined angle about the center axis of the support device fixing portion is between 90 and 120 degrees.

20. The linear compressor according to claim 16, wherein the discharge cover further includes a bottle neck portion that extends from a rear surface of the cover main body toward the valve spring assembly and that passes through the accommodation portion in the longitudinal direction of the shell.

* * * * *